US006718855B2

(12) United States Patent
Kane

(10) Patent No.: US 6,718,855 B2
(45) Date of Patent: Apr. 13, 2004

(54) ROTARY LABEL DIE CUTTER

(76) Inventor: Roger G. Kane, 1654 Lake Largo Dr., Green Bay, WI (US) 54311

( * ) Notice: Subject to any disclaimer, the term of this patent is extended or adjusted under 35 U.S.C. 154(b) by 209 days.

(21) Appl. No.: 09/809,689

(22) Filed: Mar. 15, 2001

(65) Prior Publication Data

US 2001/0010183 A1 Aug. 2, 2001

Related U.S. Application Data

(63) Continuation of application No. 09/268,172, filed on Mar. 15, 1999, now Pat. No. 6,212,984.

(60) Provisional application No. 60/078,424, filed on Mar. 18, 1998.

(51) Int. Cl.[7] ..... B26D 7/06

(52) U.S. Cl. ..... 83/50; 83/55; 83/100; 83/347; 83/665; 83/678; 83/695

(58) Field of Search ..... 83/13, 100, 177, 83/695, 678, 663, 665, 567, 343, 346, 347, 55, 50

(56) References Cited

U.S. PATENT DOCUMENTS

| | | | | | |
|---|---|---|---|---|---|
| 3,739,667 | A | * | 6/1973 | Ernst | 83/92 |
| 4,561,334 | A | | 12/1985 | Sarka | 83/27 |
| 4,846,774 | A | | 7/1989 | Bell | 493/87 |
| 4,886,566 | A | * | 12/1989 | Peyre | 156/361 |
| 4,896,573 | A | | 1/1990 | Kapolnek | 83/117 |
| 5,207,418 | A | * | 5/1993 | Oakes et al. | 271/212 |
| 5,570,620 | A | | 11/1996 | Okonski et al. | 83/152 |
| 5,879,278 | A | | 3/1999 | Cox | 493/67 |
| 6,026,725 | A | | 2/2000 | Okonski | 83/698.21 |

* cited by examiner

*Primary Examiner*—M. Rachuba
(74) *Attorney, Agent, or Firm*—Andrus, Sceales, Starke & Sawall, LLP

(57) ABSTRACT

A rotary die cutter for cutting a series of irregular-shaped blanks from a continuous web. The rotary die cutter includes a male die cylinder that has a series of die cavities formed along its outer circumference. Each of the die cavities includes a surrounding cutting edge that defines the shape of the blank to be cut. The male die cylinder is pressed into engagement with either an anvil cylinder or a female die cylinder to form either crush-cutting or shear-cutting nips therebetween. The continuous web is fed into the cutting nip such that the cutting edges of the die cavities contact the web to cut the blanks from the web. A plurality of vacuum ports positioned in the die cavities along the outer circumference of the male die cylinder are connected to a source of vacuum contained in the male die cylinder to remove the die-cut blanks from the web. The die-cut blanks are vacuum-transferred to a stacking unit, while the scrap web is continuously discarded by air-conveying removal. The die-cutting cylinders are contained in a module that can be quickly and easily interchanged on a rotary label cutting machine.

7 Claims, 4 Drawing Sheets

ROTARY LABEL DIE CUTTER

This application is a continuation of Application Ser. No. 09/268,172 filed on Mar. 15, 1999, now U.S. Pat. No. 6,212,984 B1, which is based on and claims priority from provisional patent application Ser. No. 60/078,424, filed on Mar. 18, 1998.

BACKGROUND AND SUMMARY OF THE INVENTION

There is a growing demand for small, random- or irregular-shaped die-cut blanks. For example, bottle labels and aluminum foil package lids with pull-tabs are two types of die-cut blanks that are very popular. These shapes are currently being die-cut by reciprocating die cutters either from stacked sheets or by intermittently web-fed reciprocating die cutters at average web speeds of 150 feet per minute (fpm) or less. Reciprocating die cutters have traditionally been particularly suitable for die-cutting irregular-shaped blanks because of their inherent capability to reliably and positively separate the die-cut blanks from surrounding sheet scrap or surrounding web matrix. In the die-cutting of stacked sheets, a hollow die can push the die-cut scrap away from the remaining stack of die-cut blanks, while in the die-cutting of intermittently fed web, the male die can push the blank through the female die. However, in both the die-cutting of stacked sheets and an intermittently fed web, the production speeds are quite slow.

On the other hand, present rotary die cutters can obtain high die-cutting operating speeds that are several times faster than intermittently web-fed reciprocating die cutters. However, rotary die cutters have an inherent incapacity to separate small and/or flexible material blanks from the scrap matrix web. Additionally, web-fed reciprocating die cutters have an inherent incapacity to prevent higher speed instability of the scrap matrix web from impeding the small blank delivery and thereby limiting the process speed.

Therefore, it is an object of the present invention to provide a web-fed, rotary die cutter that includes the enhanced capability of separating small and/or flexible material blanks from the scrap matrix web. It is a further object of the invention to provide a rotary die cutter that includes a die-cutting module that can replace a rectangular-label sheet cutting module in a high-speed web rotary slitting and sheeting machine. It is an additional object of the present invention to provide a rotary die cutter that can be operated at high web speeds while providing positive separation of the die-cut label blanks from the scrap matrix.

SUMMARY OF THE INVENTION

The present invention is a continuously web-fed rotary die cutter. As opposed to intermittently web-fed and sheet-fed reciprocating die cutters, continuously web-fed die cutters are particularly suitable for high-speed web production.

The rotary die cutter of the present invention includes a random-shaped die-cutting module that functions to die-cut labels of the desired size while providing positive separation of the die-cut label from the scrap web matrix. The die-cutting module includes a male die cylinder that has a series of die cavities positioned around its outer circumference. Each of the die cavities formed in the male die cylinder is surrounded by a cutting edge that defines the shape of the blank being die-cut from the continuously fed web.

The male die cylinder includes resilient elastomer pads positioned within each of the die cavities. The elastomer pad positioned within each of the die cavities interacts with either an anvil cylinder or a female die cylinder positioned adjacent to the male die cylinder to form a cutting nip. The continuous web of material travels around the outer circumference of the anvil cylinder or female die cylinder and enters into the cutting nip. The elastomer pad contained within each die cavity of the male die cylinder impresses against the outer circumference of the opposed anvil cylinder or female die cylinder.

Radial vacuum ports are provided for each die cavity along the outer circumference of the male die cylinder. The radial vacuum ports are coupled to a phased vacuum chamber such that a source of vacuum can be applied to the die-cut label blank to hold the label blank in contact with the elastomer pad formed within the die cavity. In this manner, the supply of vacuum and the elastomer pads provide positive separation of the die cut label blank from the scrap web matrix after the label blank has been die-cut by the male die cylinder.

After the label blank has been die-cut by the male die cylinder, the male die cylinder carries the label away from the cutting nip. Once the label has been transported to the desired position, the supply of vacuum within the male die cylinder is terminated such that the die-cut label blank is released from contact with the outer circumference of the male die cylinder.

The invention provides a novel way to reliably die-cut small irregular- or random-shaped blanks with positive separation and removal of the blanks from the scrap matrix web, and maintaining stable control of the scrap matrix web, thus making possible high-speed rotary die-cutting of small, irregular-shaped blanks from any web material. Further, the invention provides a module configuration of the die-cutting equipment that can be interchanged with the sheeting module of a small-rectangular-blank rotary sheeter, and a method to convert and utilize the rectangular blank rotary sheeter's delivery section to stack the irregular-shaped die-cut blanks.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings.

DETAILED DESCRIPTION OF THE INVENTION

Prior Art

Figure 1:
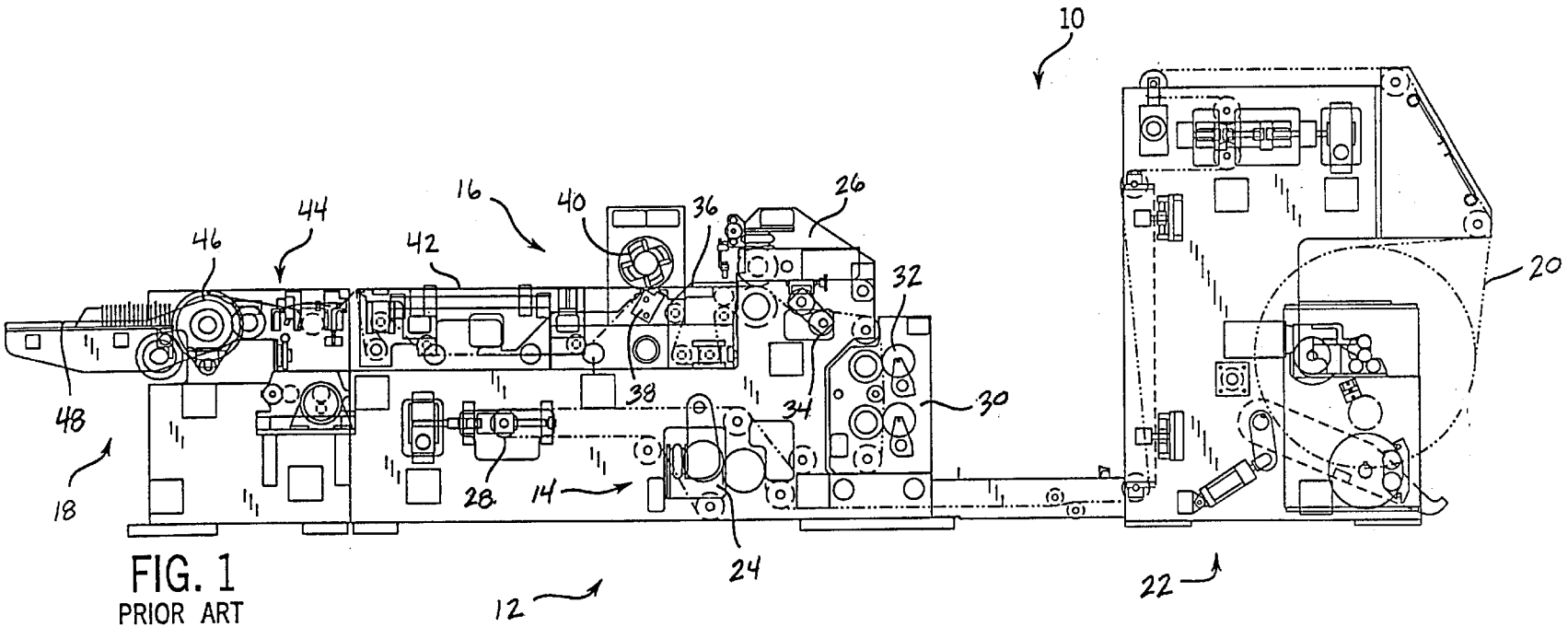
FIG. 1 PRIOR ART
FIG. 1 illustrates a prior art machine for high speed web rotary slitting and sheeting of small rectangular labels or full-machine-width rectangular strips often called "logs"

FIG. 1 shows a prior art machine 10 built for high speed web rotary slitting and sheeting of small rectangular labels or full-machine-width rectangular strips. The machine 10 consists of a cutting unit 12, comprised of a base machine 14, a rectangular-label sheet cutting module (SCM) 16, and a stacker 18.

A web material 20 to be cut is shown to be entering the cutting unit 12 from an unwind section 22 in an off-line configuration, but the label cutting machine 10 is designed to interface with and accept an entering web 20 from an up-web process machine in an alternative inline configuration as well.

In conventional rectangular label sheet cutting, as shown in FIG. 1, the web 20, shown in phantom, is drawn into the rotary label cutter base machine 14 by an infeed metering station 24. A secondary infeed draw station 26 draws the web 20 sequentially through a full-repeat register compensator station 28 to register print to cut. The web 20 is then drawn through a shear slitting module 30 including a disc slitter 32 for slitting the web 20 longitudinally into multiple web ribbons if required. The web 20 is then drawn across a spreader roll 34 for web spreading or slight separation of multiple web ribbons to preclude interleaving. The web or web ribbons leaving the secondary infeed draw station 26 are transported by vacuum belts 36 into the rectangular-label sheet cutting module (SCM) 16.

The web or web ribbons pass over a stationary machine bedknife 38 in the SCM 16 and are cross-machine-cut into the final label length by multiple machine knives helically mounted around a flyknife cylinder 40. Sheeted labels or log strips are immediately taken from the cutting point between the bedknife 38 and the flyknife cylinder 40 by vacuum belts 42, which are perforated conveyor belts running over a stationary vacuum manifold, and are conveyed downstream. The sheeted labels are then transferred to separately adjustable narrow-width vacuum belt delivery conveyor assemblies 44 that in turn transfer the labels into machined pockets in cross-machine-spaced vacuum delivery wheels 46. The vacuum delivery wheels 46 carry the labels through approximately one-quarter turn and deposit the labels onto a delivery table 48 against a horizontally accumulating stack of previously deposited vertically oriented labels.

Although the stacker 18 shown in FIG. 1 is a one-tier stacker, the rectangular label sheet cutting configuration can be used with a two-tier stacker to transfer, by orientation of vacuum belt delivery conveyor assemblies, the cut labels to two different stacker vacuum wheel/table sections at different levels. For narrow-width labels, two-tier delivery improves width access for either manual removal or robotic removal of label stacks, and offers efficiencies in vacuum wheel/delivery conveyor assembly set-up even for one-tier deliveries.

Present Invention

The present invention, as shown in FIGS. 2–6, is a rotary label cutter configuration for random-shaped die-cutting, as is generally referred to by reference numeral 50. The rotary label cutter 50 shown in FIG. 2 generally employs the same base machine 14 and one-tier stacker 18 as the prior art machine 10 for rectangular-label sheet cutting shown in FIG. 1. However, the rotary label cutter 50 includes a random shaped die-cutting module (DCM) 52 that is substituted for the SCM 16 of the rectangular label sheet cutting machine 10 shown in FIG. 1.

The rotary label cutter 50 includes the unwind section 22 that supplies the web 20 to the rotary label cutter 50 in an off-line configuration. The rotary label cutter 50 is designed to interface with and accept an entering web 20 (shown in phantom) from an up-web process machine in an alternative inline operation as well, either in rectangular label sheet cutting or random-shaped die-cutting.

Figure 2:
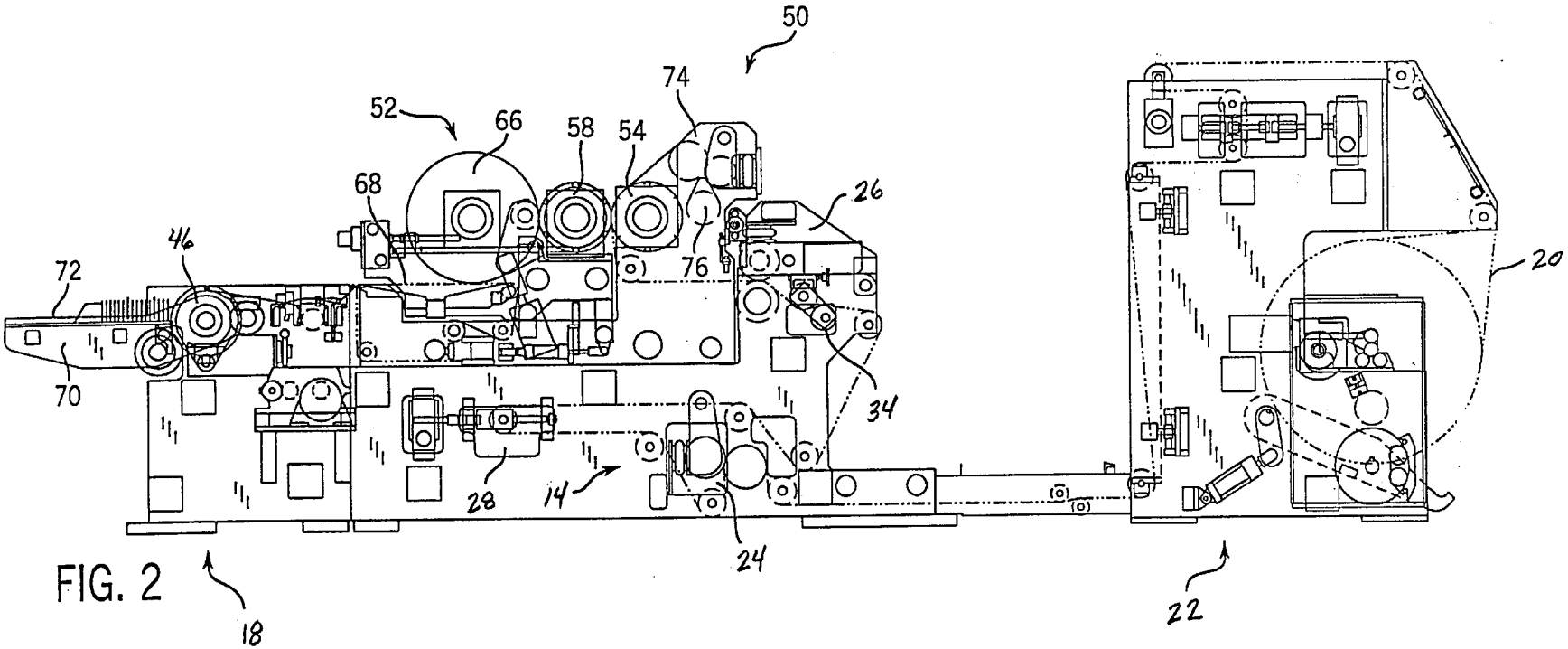
FIG. 2 is a rotary label cutter of the present invention for random-shape die-cutting.

The web 20 leaving the unwind section 22 is drawn into the base machine 14 by the infeed metering station 24. The secondary infeed draw station 26 draws the web 20 sequentially through the full repeat register compensator station 28 to register print to cut. The web 20 is then drawn over the spreader roll 34 to spread the web. However, since the rotary label cutter 50 shown in FIG. 2 die-cuts the web 20 rather than cross-machine cutting the individual web ribbons, the shear-slitting module 30 shown in FIG. 1 can either remain in place with the disc slitter 32 removed, or the shear-slitting module 30 can be completely removed from the machine as shown in FIG. 2.

Figure 4:
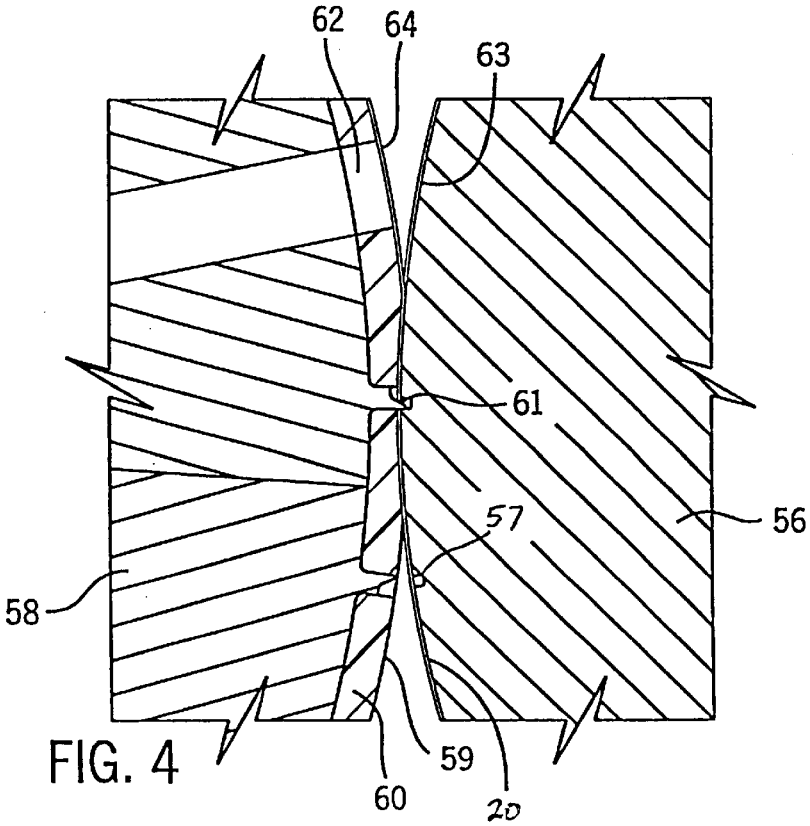
FIG. 4 is a magnified view of the cutting nip formed between the male die cylinder and female die cylinder, showing the elastomer pad contained within each die cavity.
Figure 5:
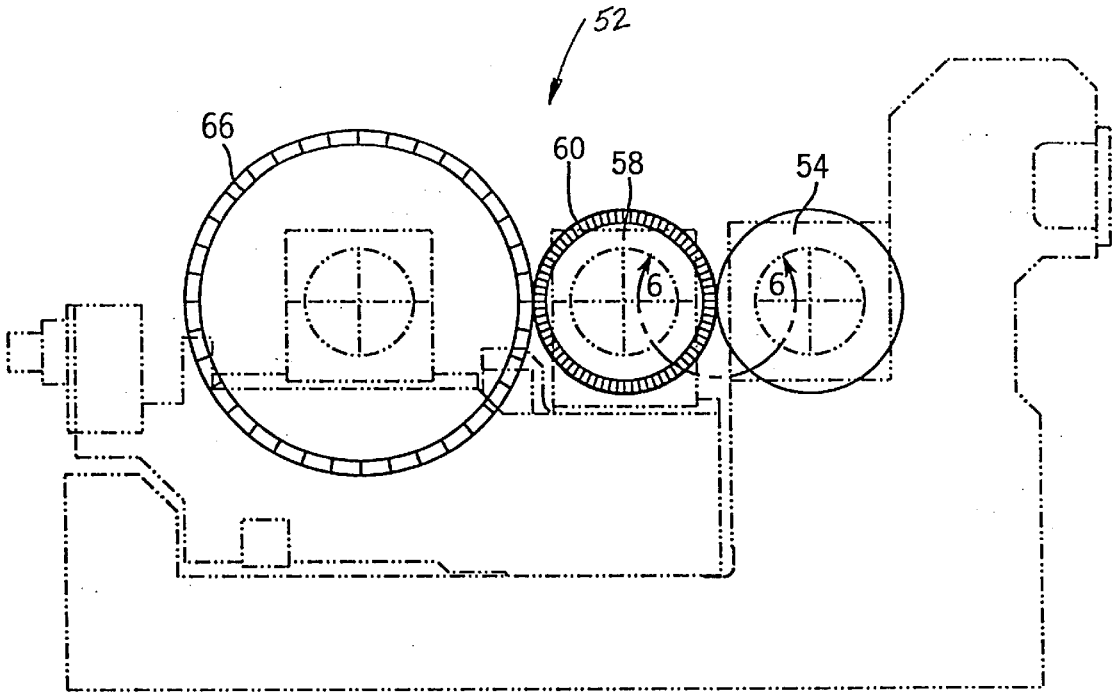
FIG. 5 is a detailed view of a second embodiment of a random shape die-cutting module of the rotary label cutter incorporating a male die cylinder and an anvil cylinder.

After the web 20 leaves the secondary draw station 26, the web 20 enters the random shaped die-cutting module (DCM) 52 and is drawn around an interchangeable anvil cylinder 54—for anvil or, synonymously, crush-cutting—or, alternatively, a repeat-dedicated interchangeable female die cylinder 56—for male/female shear die-cutting. The anvil cylinder 54 can be replaced by the female die cylinder 56, as shown in FIG. 4, for shear male/female die-cutting. The female die cylinder 56 includes recessed grooves 57 formed in its outer circumference that correspond to the shape of the cutting edge 61 to define the die-cut shape for the blanks being formed.

Figure 3:
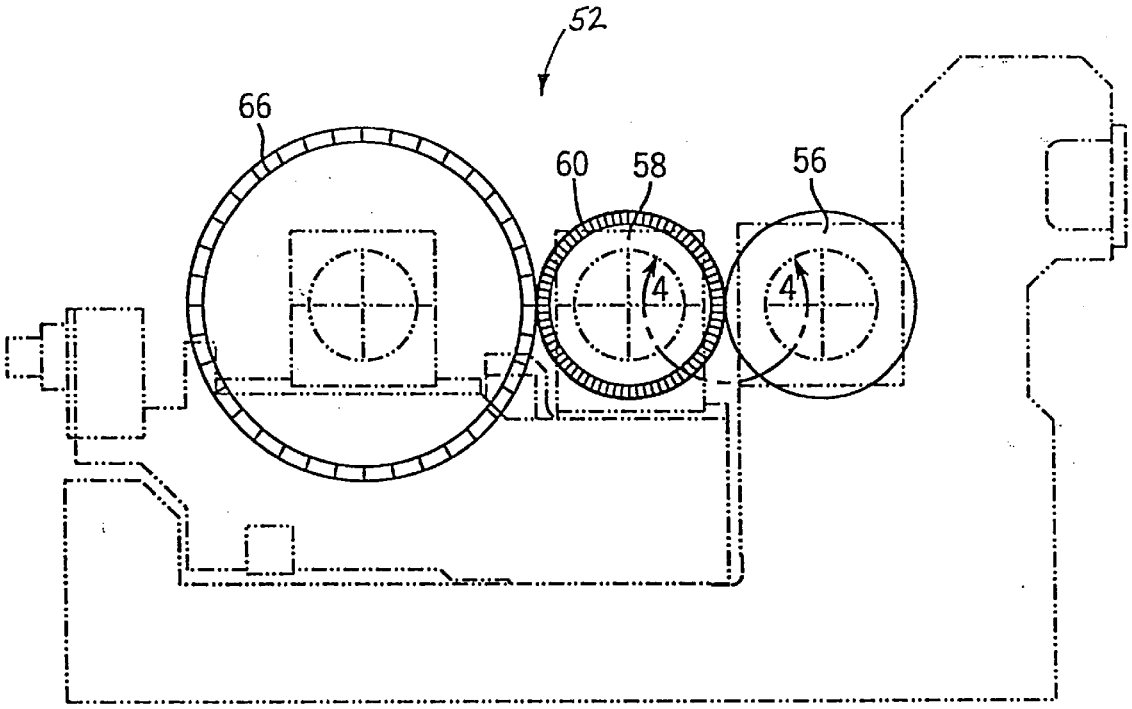
FIG. 3 is a detailed view of a first embodiment of a random-shape die-cutting module of the rotary label cutter incorporating a male die cylinder and a female die cylinder, as shown in FIG. 2.
Figure 6:
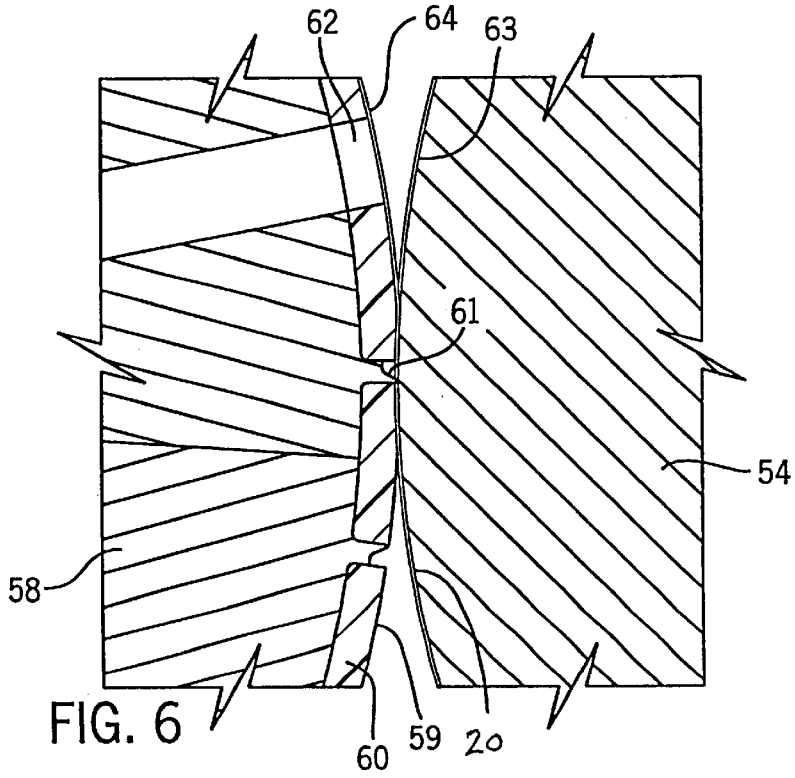
FIG. 6 is a magnified view of the cutting nip formed between the male die cylinder and the anvil die cylinder, showing the elastomer pad contained within each die cavity.

Referring now to FIGS. 3 and 6, in a preferred embodiment of the rotary die-cutting module (DCM) 50, a vacuum male die cylinder 58 with integrally machined die cavities 59 or interchangeable segment dies formed along its outer circumference is bearer-loaded against either the smooth anvil cylinder 54 (FIGS. 5–6) or the female die cylinder 56 (FIGS. 3–4) to form a cutting nip to die-cut the labels. Each of the die cavities 59 formed along the outer circumference of the male die cylinder 58 is defined by a cutting edge 61 that forms the shape of the label to be cut. In the preferred embodiment of the invention, the entire outer circumference of the male die cylinder 58 is covered with a resilient elastomer covering, forming elastomer pads 60 within the die cavities 59 having the shape of the cavities and thus the labels to be formed. In a contemplated alternate embodiment, each of the die cavities 59 could be formed without the elastomer pad 60. In this embodiment, the die cavity 59 would still be defined by the cutting edge 61, but would include a raised center portion set off from the cutting edge by a recessed grove.

The elastomer pads 60 and cavities 59 of the male die cylinder 58 are each connected to a phased vacuum chamber in the interior of the male die cylinder 58 by at least one radial vacuum port 62. In the preferred embodiment, each of the die cavities 59 includes a plurality of vacuum ports 62 distributed within the respective die cavity 59.

As the labels 64 are die-cut, the elastomer pads 60 within the die cavities 59 impress against the female die cylinder 56 or anvil cylinder 54 and web 20 such that the radial vacuum ports 62 vacuum-attach the label 64 to the circumferential surface of the male die cylinder 58 while the surrounding non-vacuum elastomer outside the die cavity 59 impresses the web scrap material 63 against the female die cylinder 56 or anvil cylinder 54. As the male die cylinder 58 disengages from the female die cylinder 56 or anvil cylinder 54, the vacuum applied to the radial vacuum ports 62 for the elastomer pad 60 contained within the die cavity 59 lifts the die-cut label 64 from the scrap matrix web 63 as the scrap matrix web 63 remains in contact with and passes around the female die cylinder 56 or anvil cylinder 54.

Although not shown, enhanced impressing of the scrap matrix web 63 on the shape-dedicated female die cylinder 56 for male/female shear die-cutting or even on the repeat-dedicated anvil cylinders 54 can be provided by a phased vacuum chamber in the interior of the female die cylinder 56 or anvil cylinder 54. The phased vacuum chamber in the female die cylinder 56 or the anvil cylinder 54 is then connected by radial vacuum holes to the web scrap matrix contact areas on those cylinders. The web scrap matrix 63 will be held by vacuum to the female die cylinder 56 or anvil cylinder 54 through the cut until the male die roll elastomer pads 60 have completely detached the die-cut labels 64 from the web scrap matrix 63.

Die-cut labels 64, still vacuum attached to the elastomer pads 60 in the male die cylinder cavities 59 by the vacuum applied in the radial vacuum ports 62, rotate with the male die cylinder 58 approximately one-half of a revolution, whereupon the vacuum is broken in the internal vacuum chamber, allowing the labels 64 to release from the elastomer pads 60. Simultaneously with vacuum release within the male die cylinder 58, an adjacent vacuum transfer cylinder 66 impressed against the male die cylinder elastomer 60 vacuum-grasps the labels 64 from the male die cylinder 58 and carries the labels 64 to vacuum take-away belts 68, as shown in FIG. 2. The vacuum take-away belts 68 in turn vacuum-grasp the labels 64 from the transfer cylinder 66 upon its vacuum break and convey the labels 64 to the vacuum delivery wheels 46. The vacuum wheels 46 successively deposit the labels into shape-dedicated formed chutes 70 on the delivery table 72.

After the labels 64 have been removed from the web, the web scrap matrix 63 continues to travel around either the female die cylinder 56 or the anvil cylinder 54 and is fed into the matrix outfeed station 74. The matrix outfeed station 74 includes a trim removal duct 76 for automatic air conveying of the web scrap matrix 63 into a scrap removal system.

Although the rotary label cutter 50, as shown in FIG. 2, includes a one-tier stacker 18, the present invention is contemplated as being operable with an alternative two-tier stacker to transfer, by orientation of vacuum belt delivery conveyor assemblies, labels from alternating rows to two different stacker vacuum wheel table sections at different levels. As with the rectangular labels shown in FIG. 1, the two-tier delivery system improves width access for either manual removal or robotic removal of the stacks of labels and offers efficiencies in vacuum wheel/delivery conveyor assembly set-up in one-tier deliveries. But in random shape die-cutting, alternating row two-tier delivery offers a far more significant advantage of permitting a high degree of nesting or interlocking label shapes cross-machine, to save material scrap, retaining only non-nested minimal-width machine-direction tracks or paths in the web for vacuum-delivery belt blank contact.

Various alternatives and embodiments are contemplated as being within the scope of the following claims particularly pointing out and distinctly claiming the subject matter regarded as the invention.

I claim:

1. A method of rotary die cutting random shaped blanks from a continuous web of flexible packaging material, the method comprising the steps of:

providing a male die cylinder including a series of die cavities positioned along its outer circumference, each die cavity defined by a cutting edge that forms the shape of the blank to be die cut from the web;

positioning a resilient pad within each die cavity formed on the male die cylinder;

positioning a female die cylinder in contact with the male die cylinder to create a cutting nip therebetween;

receiving the continuous web along an outer circumference of the female die cylinder;

rotating the female die cylinder to move the continuous web through the cutting nip to die cut the random shaped blank from the web;

supplying a source of vacuum to each die cavity as the random shaped blank is die cut from the web at the cutting nip such that the source of vacuum holds the blank in contact with the male die cylinder after the blank has been die cut from the web;

rotating the male die cylinder to separate the blank from the web and move the blank away from the cutting nip;

rotating the male die cylinder into contact with a vacuum transfer roll; and removing the source of vacuum from the die cavity to release the blank into contact with the vacuum transfer roll.

2. The method of claim 1 further comprising the step of providing a vacuum port between each of the die cavities and a source of vacuum in the interior of the male die cylinder, wherein each vacuum port extends through the resilient pad positioned within the die cavity.

3. The method of claim 1 further comprising the step of supplying a source of vacuum to the female die cylinder to hold the portion of the continuous web other than the random shaped blank in contact with the female die cylinder after the random shaped blank has been die cut from the web.

4. The method of claim 1 further comprising the step of compressing each resilient pad between the anvil cylinder and the male die cylinder as the resilient pad moves through the cutting nip, wherein the random shaped blank is in contact with the resilient pad as the random shaped blank is die cut from the web.

5. The method of claim 1 wherein the female die cylinder includes a series of recessed grooves formed in its outer circumference that correspond to the cutting edges formed on the male die cylinder that define each die cavity.

6. The method of claim 1 further comprising the steps of:

rotating the vacuum transfer roll such that the blank is brought into contact with a vacuum takeaway conveyor;

releasing the blank from the vacuum transfer roll such that the blank is transferred from the vacuum transfer roll to the vacuum takeaway conveyor;

moving the blank along with the vacuum takeaway conveyor into contact with a rotating vacuum wheel, the vacuum wheel having a source of vacuum to hold the blank in contact with the vacuum wheel; and rotating the vacuum wheel to remove the blank from the vacuum takeaway conveyor and deposit the blank into a chute to form a stack of blanks within the chute.

7. The method of claim 6 wherein the chute has a shape corresponding to the random shape of the blank being die cut from the web of flexible packaging material.

* * * * *